United States Patent [19]

Spear et al.

[11] 4,011,928

[45] Mar. 15, 1977

[54] ELEVATOR SYSTEM

[75] Inventors: Richard M. Spear, Jersey City; Lawrence P. Tosato, Millburn, both of N.J.

[73] Assignee: Westinghouse Electric Corporation, Pittsburgh, Pa.

[22] Filed: June 6, 1975

[21] Appl. No.: 584,431

[52] U.S. Cl. ..... 187/29 R

[51] Int. Cl.[2] ..... B66B 13/24

[58] Field of Search ..... 187/29 R

[56] References Cited

UNITED STATES PATENTS

| | | | |
|---|---|---|---|
| 3,792,759 | 2/1974 | Kirsch | 187/29 R |
| 3,815,710 | 6/1974 | Shrum | 187/29 R |

*Primary Examiner*—Herman J. Hohauser
*Attorney, Agent, or Firm*—D. R. Lackey

[57] ABSTRACT

An elevator system including a transmitter-receiver arrangement for detecting mechanical damage to the elevator system, such as might be caused by an earthquake. A transmitter carried by the counterweight provides a signal for a remotely located receiver, as long as the counterweight moves within its normal vertical path. Movement of the counterweight outside of this path terminates the transmitter signal and a control device operated by the receiver modifies the operation of the elevator system.

9 Claims, 5 Drawing Figures

ELEVATOR SYSTEM

BACKGROUND OF THE INVENTION

1. Field of the Invention

The invention relates in general to elevator systems, and more specifically to elevator systems which include controls for detecting damage to the elevator system, such as caused by an earthquake, and then modifying the operation of the elevator system.

2. Description of the Prior Art

U.S. Pat. No. 3,792,759, which is assigned to the same assignee of the present application, discloses a dual level detector arrangement for an elevator system in which at least the first level of detection is responsive to acceleration forces applied to the associated building. The two detection levels are arranged to provide an early warning of earthquake, without nuisance service outages. The second level of detection may be responsive to acceleration forces of a higher magnitude than the first level of detection, or it may be responsive to mechanical damage to the elevator system, such as displacement of the counterweight from its guides.

U.S. Pat. Nos. 3,783,978, 3,791,490; and 3,815,710 disclose different arrangements for detecting damage to an elevator system, which include (a) detecting the interruption of a sliding or rolling electrical contact maintained between a movable component of the elevator system and a wire or track in the hoistway, (b) detecting the mechanical contact between a conductive ring disposed on a movable component of the elevator system and a vertical wire which extends the length of the hoistway on the center line on the conductive ring, and (c) detecting mechanical contact between a plumb bob and an encircling metallic ring arrangement, both of which are carried by one of the movable components of the elevator system.

While the prior art arrangements are effective in detecting mechanical damage to the elevator system, it would be desirable to provide a new and improved arrangement for detecting damage to an elevator system which eliminates the need for connecting a traveling cable to the counterweight, or does not require continuous mechanical and electrical contact between a movable member and a stationary track or wire which runs the length of the hoistway.

SUMMARY OF THE INVENTION

Briefly, the present invention is a new and improved elevator system which detects mechanical damage to one of its movable components, such as displacement of the counterweight from its guides, without requiring a traveling cable on the counterweight, or a continuous mechanical and electrical connection between the counterweight and a special conductive track in the hoistway. A transmitter carried by the counterweight is continuously energized via an electrical circuit which includes a battery and a plurality of serially connected normally closed contacts each disposed to be actuated to an open condition by an abnormal horizontal movement of the counterweight. A receiver located remotely from the counterweight is tuned to the frequency of the transmitter. The receiver operates a control device, such as a relay, which has contacts disposed in the elevator drive control. When the counterweight is operating in its normal vertical path, the transmitter transmits a frequency or tone which is received by the receiver and the control device is maintained in a condition which has no effect on the elevator drive control. If the counterweight is dislodged from its normal vertical path, one or more of the plurality of serially connected contacts will open and the transmitter will cease to provide a signal for the receiver. The associated control device will be operated and its contacts in the elevator drive control will modify the operation of the elevator system, such as by preventing a stationary car from starting, and by stopping a moving car with or without regard to its stopped position relative to a floor level, as desired.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
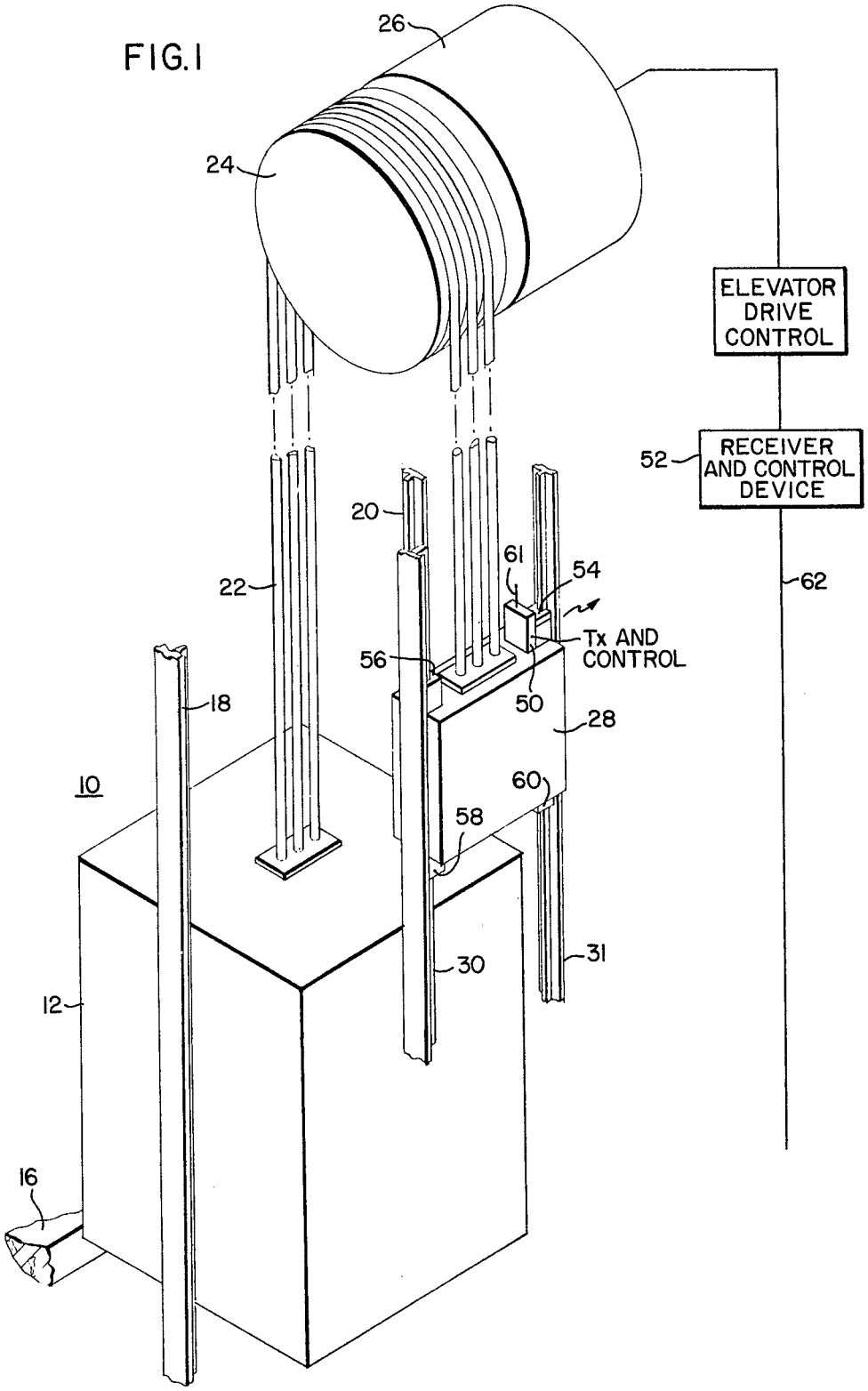
FIG. 1 is a perspective view of an elevator system constructed according to the teachings of the invention.

Referring now to the drawings, and FIG. 1 in particular, there is shown an elevator system 19 constructed according to the teachings of the invention. Elevator system 10 includes an elevator car 12 mounted for movement relative to a structure having a plurality of floors or landings, such as the landing indicated generally at 16. The elevator car 12, which is guided in a vertical path by T-shaped guide rails 18 and 20, is supported by wire ropes 22 in a hoistway of the structure or building, with the ropes 22 being reeved over a traction sheave 24 mounted on the shaft of suitable motive means, such as a drive motor 26. A counterweight 28, guided in a vertical path by T-shaped guide rails 30 and 31, is connected to the other end of the rope 22.

The motor 26 drives the sheave 24 in response to elevator control, shown generally at 48. According to the teachings of the invention, the control 48 is modified when damage to the elevator system is detected by a new and improved damage detection system which includes transmitter means carried by the counterweight 28, which is indicated generally at 50, and receiver means 52 located remotely from the counterweight 28, such as in the penthouse where the control 48 and drive motor 26 are conventionally located.

A plurality of damage detector devices, shown generally at 54, 56, 58 and 60 are disposed on the counterweight 28 to detect abnormal horizontal movement of the counterweight, with each of the detector devices including normally closed electrical contacts, actuatable to an open condition when abnormal horizontal movement of the counterweight is detected. The transmitter 50 is energized by a series circuit which includes a battery 62 (shown in FIGS. 2, 3 and 4) and electrical contacts 54-1, 56-1, 58-1 and 60-1 (shown in FIG. 4), of the detection devices 54, 56, 58 and 60, respectively. When the counterweight 28 is constrained within its normal vertical operating path, the transmitter 50 radiates electromagnetic radiation at a predetermined frequency, or within a predetermined frequency band, from a suitable antenna 61. The receiver 52 is tuned to the frequency of the transmitter, and when the signal from the transmitter is being received, the receiver 52 maintains a control device in a first predetermined operating condition. Absence of the signal from the transmitter causes the receiver 52 to operate the control device to a second condition. The control device has electrical contacts connected in the control 48, which modify the operation of the control 48 when the control device is in its second operating condition. The receiver 52 may have an antenna 62 disposed in the hoistway, such as along the travel path of the counterweight 28.

Figure 3:
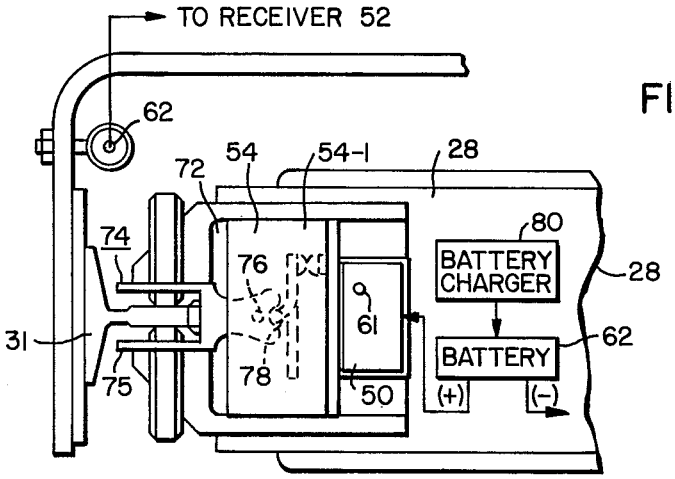
FIGS. 2 and 3 are fragmentary, elevational and plan views, respectively, of a portion of the elevator system of FIG. 1, illustrating an exemplary placement of certain components of the damage detection equipment on the counterweight.
Figure 2:
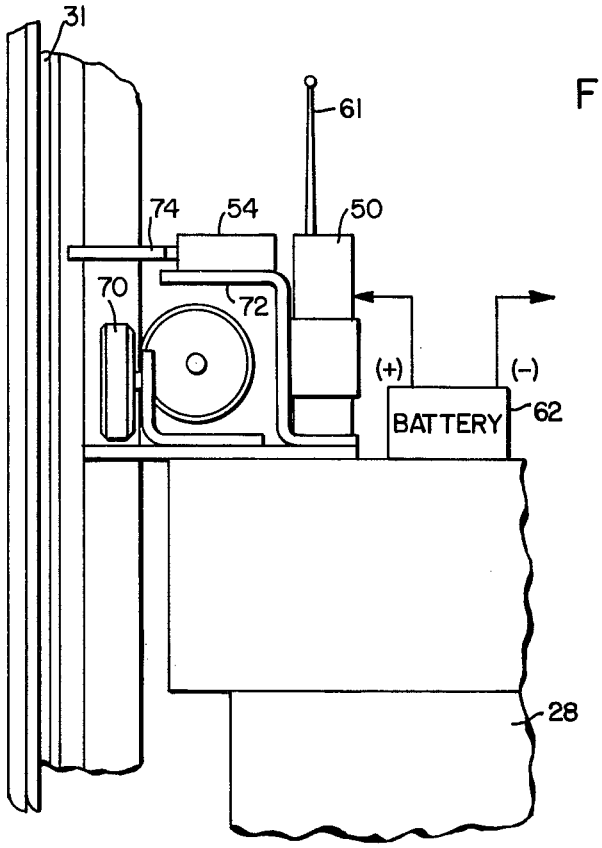

FIGS. 2 and 3 are enlarged, fragmentary, elevational and plan views, respectively, of counterweight 28 and damage detector 54. The counterweight 28 is guided in its vertical path by guide roller assemblies at each of its four corners, such as guide roller assembly 70, which has three rollers disposed against the side guide surfaces and face of the T-rail 31. Damage detector 54 may be mounted directly above guide roller assembly 70, such as on one of the parallel portions of the Z-shaped bracket 72. The other parallel portion of the bracket 72 may be mounted directly to the top of the counterweight 28, and it may also be used to support the transmitter 50.

The damage detector 54, as shown most clearly in FIG. 3, includes an actuating member having first and second ends 75 and 78, respectively, and a vertical pivot axis. The first end 75 is fork or U-shaped. A pin 76 is disposed through the actuating member 74 to function as the vertical pivot axis for the actuator 74. The second end 78 has a predetermined cam shape which actuates electrical contact 54-1 between closed and open positions when the actuator 74 pivots about the vertically disposed pin 76. The legs of the U-shaped end 75 are disposed to straddle the outwardly extending stem end of the T-rail 31. When the counterweight 28 is properly within its guides, the legs of the U-shaped end 75 are equally spaced from the side guide surfaces of the T-rail 31, and the cam end 78 of the actuator 74 is positioned to cause contacts 54-1 to be in a closed position. In the event of a shock to the building of sufficient force to dislodge the counterweight 28 from its normal vertical operating path, one or more of the damage detectors, such as damage detector 54, will be pivoted about its vertical pivot axis due to horizontal movement of the counterweight 28 which causes the actuator 74 to contact the T-rail 31. The cam end 78 forces the contacts of the detector to their open position, and the transmitter 50 ceases to provide a signal.

Figure 4:
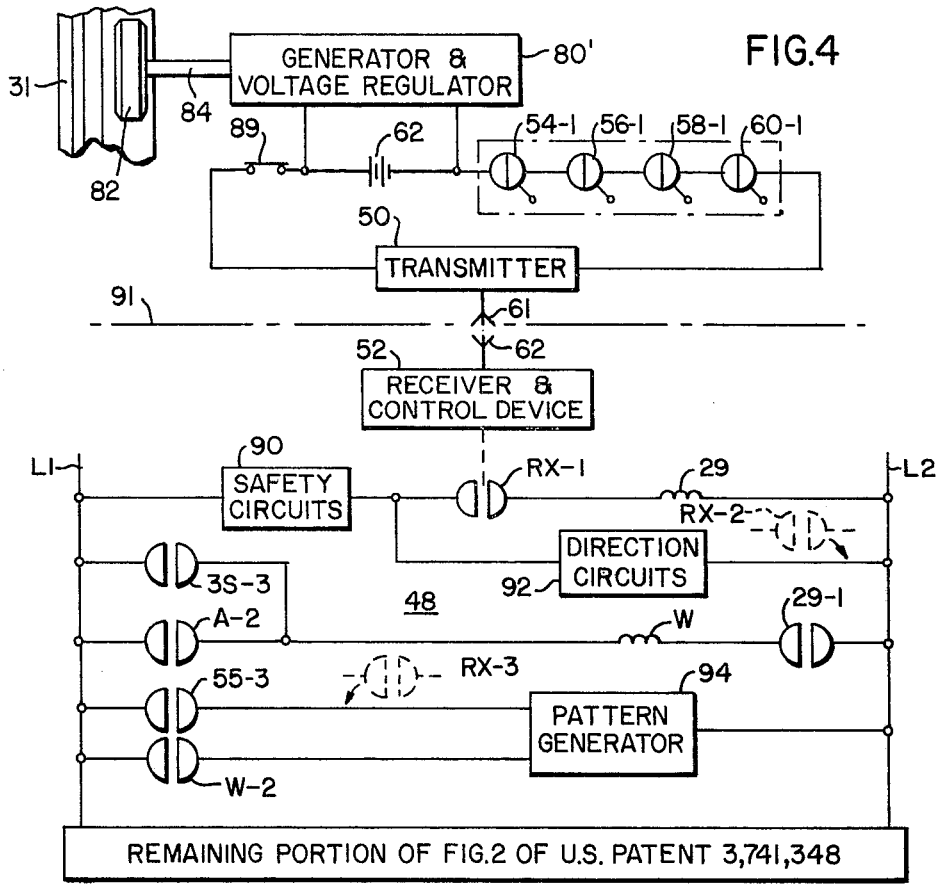
FIG. 4 is a schematic diagram of elevator control constructed according to the teachings of the invention.

As illustrated in FIGS. 2 and 3, the battery 62 is mounted on the counterweight 28 adjacent the transmitter 50. The weight of the battery is no problem, as it may be taken into consideration when selecting the overall weight required for the counterweight. A suitable battery charger 80 may also be mounted on the counterweight 28. An example of a suitable battery charger is shown in FIG. 4. If the transmitter 50 is constructed of solid-state components of the type which present a very small drain to a storage battery, the battery charger 80 may be eliminated and the battery simply periodically exchanged for a fully charged battery on a regular maintenance schedule. If the battery should lose its charge before the normal exchange interval, the disclosed arrangement is fail safe, as the transmitter 50 will cease operating and initiate the modification of the elevator drive control, which will call attention to the fact that the battery should be exchanged.

FIG. 4 is a schematic diagram of a portion of an elevator control system, which may be the control system shown generally at 48 in FIG. 1. The control of any elevator system may be modified to operate according to the teachings of the invention. For purposes of example, the elevator control disclosed and described in U.S. Pat. No. 3,741,348, which is assigned to the same assignee as the present application, will be used to illustrate the invention. Only a portion of the control illustrated in U.S. Pat. No. 3,741,348 which is necessary to understand the present invention is shown in the present application, as reference may be had to this patent for additional information, if required.

The relay contacts in FIG. 4 of the present application are identified by hyphenated reference characters. The portion of the reference character before the hyphen identifies the relay with which the contacts are associated, and the number after the hyphen identifies the contacts on the associated relay. All of the relay contacts are shown in their normal position when the relay is deenergized.

As an aid to understanding FIG. 4, the relays and switches are identified as follows:

A — Brake Monitor Relay
W — Pattern Selector Relay
3S — Running Relay
29 — Safety Circuit Relay
55 — Overspeed Relay
54, 56, 58 and 60 — Damage Detectors More specifically, FIG. 4 illustrates the energization of transmitter 50 via a series circuit which includes an on-off switch 89, the battery 62, and the serially connected damage detector contacts 54-1, 56-1, 58-1 and 60-1. These components, and a battery charger 80′, if used, are mounted on the counterweight 28, which is illustrated in the figures as being above the broken line 91. As illustrated in FIG. 4, the battery charger 80′ may simply be an A.C. generator and rectifier, with a voltage regulator. The A.C. generator may be driven by roller 82 mounted on a drive shaft 84, with the roller 82 being driven during car movement by frictional contact with the guide rail 31.

It would also be suitable to provide an electrical contact mounted on an insulator on the counterweight which will engage a contact mounted in the hoistway when the counterweight is located in an "off hours" position. The contact in the hoistway would be connected to a D.C. potential suitable for charging the battery, and the battery would be connected to be charged by the contact on the counterweight.

The transmitter 50, which may be any commercially available single channel tone transmitter, such as Model TTX Tone Transmitter shown on page 205 of Lafayette Catalog No. 690, operates at a predetermined frequency, such as 26.995, 27.045, 27.090, 27.195 or 27.255 MHz.

The components shown in FIG. 4 below the broken line 91 are mounted in the penthouse, or other suitable location remote from the movable components of the elevator system, and are part of the control 48 illustrated in block form in FIG. 1.

Control 48 includes a safety circuit relay 29 connected between electrical buses L1 and L2 via conventional elevator safety circuits, shown generally at 90, and through the break or normally open contacts RX-1 which are responsive to a control device, such as a relay, whose operating condition is determined by whether or not receiver 52 is receiving a signal from the transmitter 50. Receiver 52 is tuned to the frequency transmitted by transmitter 50, and when receiver 52 receives a signal the receiver maintains a control device in an operating condition in which contacts RX-1 are closed, enabling the safety relay 29 to be energized through the normal safety circuits 90 of the elevator system. Receiver 52 is a single channel receiver tuned to the frequency of transmitter 50, such as Model SSHP Receiver shown on page 205 of Lafayette Catalog No. 690. The safety circuit relay 29 has contacts 29-1 which enable the operation of the pattern selector relay W.

The up direction circuits shown generally at 92 are connected to be energized through the safety circuits 90. The pattern selector relay W is energized through contacts 29-1 when the running relay 3S (not shown) is energized via contacts 3S-3 of the running relay, and it remains energized until the brake is applied, indicated by contacts A-1 of the brake monitor relay A (not shown) opening. Relay W has make contacts W2 connected in the circuit of a pattern generator 94.

The pattern generator 94, which is shown in detail in U.S. Pat. No. 3,741,348, energizes solenoids which lift pawls clear of the floor stops located in the pattern generator. The stop relay (not shown) breaks this circuit when energized to stop the car at a landing. The overspeed relay 55 (not shown) is energized through an overspeed switch, which opens at a predetermined percentage of overspeed, such as 10%. The overspeed relay 55 has contacts 55-3 which open when relay 55 drops out, to drop the pawls and thus stop the car at the closest landing at which the car can make a normal stop.

Contacts W-2 of the pattern selector relay are also connected to the pattern generator 50, in a circuit which normally opens when the floor stop of a pattern generator is captured by a dropped pawl. If the safety relay 29 is deenergized, relay W drops to open contacts W-2, which simulates the capturing of a floor stop by a pawl, stopping the car without regard to its location relative to a landing.

In the operation of the damage detector system, when any one of the damage detector contacts 54-1, 56-1, 58-1 or 60-1 open in response to an abnormal horizontal movement of the counterweight, transmitter 50 ceases to provide an output signal and the control device responsive to receiver 52 is operated to the condition which opens contacts RX-1. The safety relay 29 drops, opening its contacts 29-1 and the opening of contacts 29-1 deenergizes the pattern selector relay W. Contacts W-2 of the pattern selector relay thus open, to immediately initiate slowdown of a moving elevator car. The elevator car thus stops without regard to its stop location relative to a floor level. A car which is already stopped at a floor when the safety relay 29 is deenergized, cannot be started.

Instead of stopping a moving car without regard to its stopped location relative to a landing, a moving car may be stopped at the closest landing in its travel direction at which it can make a normal stop, by eliminating contacts RX-1, by adding contacts RX-2, shown in phantom in FIG. 4, between the direction circuits 92 and bus L2, which prevents the starting of a stationary car when receiver 52 is not receiving a signal from transmitter 50, and by adding contacts RX-3, also shown in phantom in FIG. 4, in series with contacts 55-3. Contacts RX-3, when they open due to the receiver 52 not receiving a signal from transmitter 50, will stop a moving car at the closest floor in its travel direction at which it can make a normal stop.

As described in the hereinbefore mentioned U.S. Pat. No. 3,792,759, the speed of the elevator car may be automatically reduced, if desired, by appropriately located contacts from the control device operated by the receiver 52. Also as disclosed in this patent, a manually operated override switch may be concealed in the elevator car, the location of which is known only to authorized personnel. This override switch, when actuated, operates an override relay which permits operation of the elevator car at reduced speed.

Figure 5:
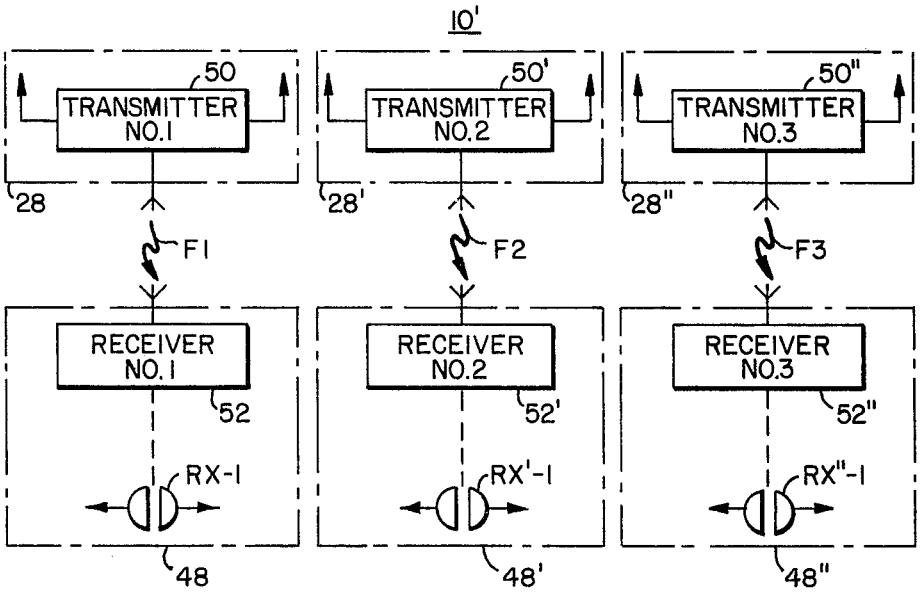
FIG. 5 is a block diagram which illustrates an elevator system having a plurality of elevator cars, and an arrangement for preventing the damage detector arrangement of one elevator car from affecting the damage detector arrangement of another elevator car.

FIG. 5 is a block diagram of an elevator system 10′ which is similar to the elevator system 10 shown in FIG. 1, except it has a plurality of elevator cars, such as three. Like reference numerals with prime marks are used to identify like components and functions in the two additional elevator car installations. FIG. 5 illustrates that the transmitters associated with each of the three elevator cars operate at different frequencies F1, F2 and F3, such as 26.995, 27.045 and 27.090 MHz., respectively, and the associated receivers are each tuned to the frequency of its transmitter. This arrangement eliminates the possibility of a receiver associated with one elevator car from receiving a signal from transmitters associated with other elevator cars of the bank of cars.

In summary, there has been disclosed a new and improved elevator system which includes means for detecting damage to a movable component of the system, such as abnormal horizontal movement of the counterweight, and means responsive to such detection for modifying the operation of the drive control of the elevator system. The means for detecting damage does not require a traveling cable to the counterweight, nor does it require a continuous track which runs the length of the hoistway which must be in continuous mechanical and electrical contact with a movable element of the elevator system in order for the elevator system to operate normally. Thus, the installation of the elevator system is simplified, as well as the maintenance thereof. It is also relatively easy to add the damage detector arrangement of the present invention to an existing elevator installation.

We claim as our invention:

1. An elevator system, comprising:

a movable component, motive means for driving said movable component, guide means for guiding said movable component in a vertical path, detector means operable from a first to a second condition in response to a predetermined horizontal movement of said movable component, transmitter means carried by said movable component, said transmitter means providing an output signal only when said detector means is in its first condition, and receiver means remote from said movable component responsive to said transmitter means, said receiver means including control means operable from a first to a second condition when said receiver means fails to receive an output signal from said transmitter means, said control means modifying the operation of said motive means when it is in its second condition.

2. The elevator system of claim 1 wherein the movable component which carries the transmitter means is a counterweight.

3. The elevator system of claim 1 wherein the guide means includes a T-rail and the detector means includes a U-shaped actuator disposed to straddle the T-rail such that a predetermined horizontal movement of the movable member will cause the T-rail to contact the U-shaped actuator.

4. The elevator system of claim 1 including power supply means, said power supply means including an electrical storage device carried by the movable component, and means for charging said electrical storage device carried by the movable component.

5. The elevator system of claim 4 wherein the means for charging the electrical storage device includes an electrical generator and means for driving said electrical generator by frictional contact with the guide means when the movable member is being driven by the motive means.

6. The elevator system of claim 1 wherein the guide means includes first and second spaced T-rails, and the detector means includes at least first and second serially connected, normally closed contacts actuatable by first and second U-shaped actuator means disposed to straddle the first and second T-rails, respectively, wherein a predetermined horizontal movement of the movable component will contact an actuator means and cause its associated normally closed contacts to open, and wherein the opening of any of said normally closed contacts is the second condition of the detector means.

7. The elevator system of claim 1 including antenna means connected to the receiver means, said antenna means being disposed adjacent to the vertical path of the movable component.

8. The elevator system of claim 1 wherein the detector means includes a plurality of serially connected normally closed contacts and actuator means disposed to open its associated normally closed contacts responsive to predetermined horizontal movement of the movable component, and including battery means, with the transmitter means being energized by said battery means via said plurality of serially connected normally closed contacts.

9. An elevator system, comprising:

at least two elevator cars and associated connected counterweights, motive means for each of said elevator cars and associated counterweights, guide means for guiding each of said elevator cars and associated counterweights in vertical paths, detector means carried by each of said counterweights, said detector means being operable from a first to a second condition in response to a predetermined horizontal movement of its associated counterweight, transmitter means carried by each of said counterweights, said transmitter means providing output signals in non-overlapping frequency bands when their associated detector means is in its first condition, and terminating the output signal when its associated detector means is in its second condition, and receiver means for each of said transmitter means tuned to the frequency band of its associated transmitter means, each of said receiver means including control means operable from a first to a second condition when it fails to receive an output signal from its associated transmitter means, each of said control means modifying the operation of the associated motive means when it is in its second condition.

* * * * *